US006062561A

United States Patent [19]

Wainwright et al.

[11] Patent Number: 6,062,561

[45] Date of Patent: May 16, 2000

[54] METHOD OF PLAYING A BOARD GAME

[76] Inventors: Max R. Wainwright; David A. Wainwright, both of 13065 Mindanao Way #19, Los Angeles, Calif. 90292

[21] Appl. No.: 09/088,016

[22] Filed: Jun. 1, 1998

[51] Int. Cl.[7] ..... A63F 3/00

[52] U.S. Cl. ..... 273/236; 273/271; 273/267; 273/282.1

[58] Field of Search ..... 273/271, 267, 273/236, 282.1

[56] References Cited

U.S. PATENT DOCUMENTS

| | | | |
|---|---|---|---|
| 508,754 | 11/1893 | Quick | 273/236 |
| 4,645,209 | 2/1987 | Goulter et al. | 273/271 |
| 4,896,889 | 1/1990 | Kuhn et al. | 273/272 |

*Primary Examiner*—Benjamin H. Layno

[57] ABSTRACT

A new board game for providing an entertaining and challenging way for learning arithmetic facts is disclosed. The inventive game includes the steps of providing a game board having a plurality of playing spaces arranged in an equal number of rows and columns, providing two sets of playing markers, one set for each of two players, each set of playing markers being distinguishable one from the other, selecting the order of play, each player on his alternating turn placing a playing marker on a playing space until all of the playing spaces have a playing marker placed thereon, and allocating a numerical score to each player for each placement of a playing marker upon a playing space. The players are rewarded with successively higher scores for placing their playing markers upon the playing spaces in such manner that the playing markers are positioned upon the playing spaces in adjacent playing spaces.

11 Claims, 3 Drawing Sheets

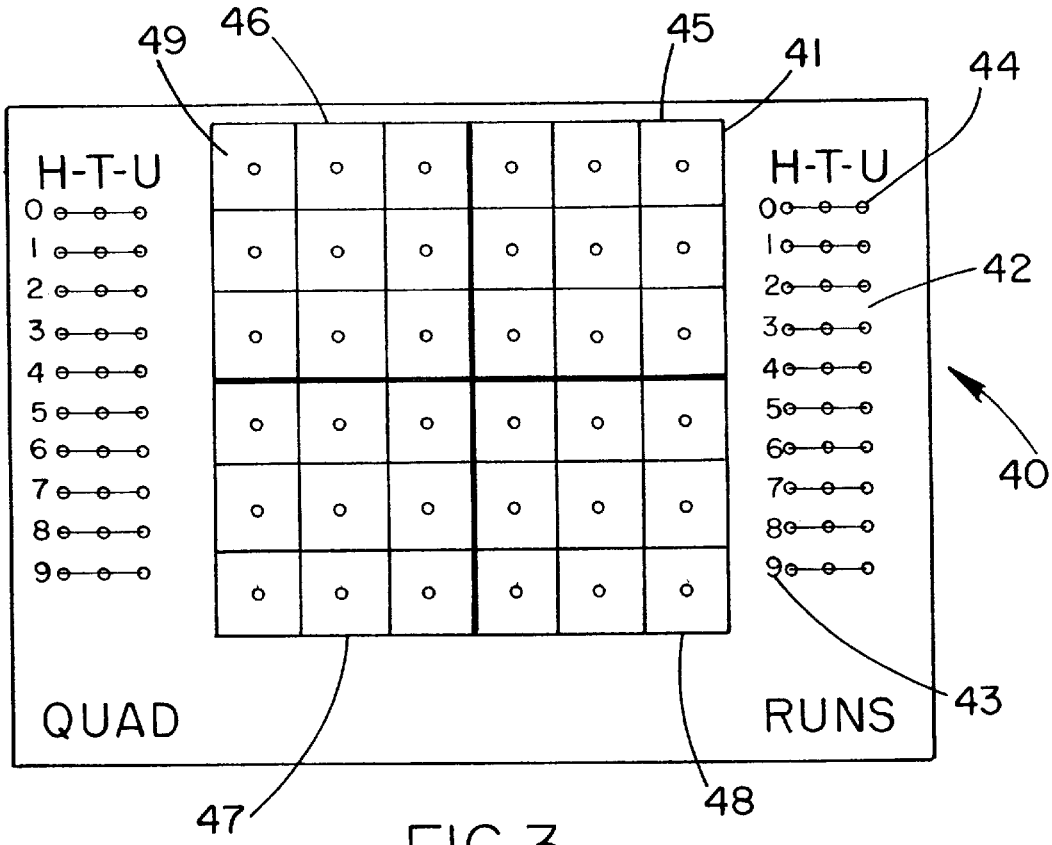
FIG. 3
| QUADRUNS SCORE SHEET | | | |
|---|---|---|---|
| RED | TOTAL | GREEN | TOTAL |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
50
FIG. 4
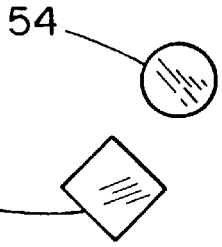
FIG. 5
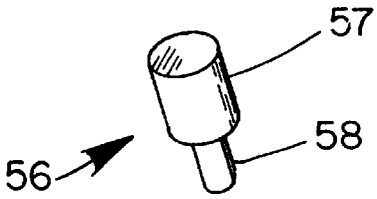
FIG. 6

METHOD OF PLAYING A BOARD GAME

BACKGROUND OF THE INVENTION

1. Field of the Invention

The present invention relates to board games and more particularly pertains to a new board game for providing an entertaining and challenging means for learning arithmetic facts.

2. Description of the Prior Art

The use of board games is known in the prior art. Known prior art board games include U.S. Pat. No. 4,261,574; U.S. Pat. No. 4,138,120; U.S. Pat. No. Des. 317,791; U.S. Pat. No. 4,196,905; U.S. Pat. No. 4,700,951; and U.S. Pat. No. 4,213,616.

While these games fulfill their respective, particular objectives and requirements, the aforementioned patents do not disclose the board game of the present invention. The inventive game includes the steps of providing a game board having a plurality of playing spaces arranged in an equal number of rows and columns, providing two sets of playing markers, one set for each of two players, each set of playing markers being distinguishable one from the other, selecting the order of play, each player on his alternating turn placing a playing marker on a playing space until all of the playing spaces have a playing marker placed thereon, and allocating a numerical score to each player for each placement of a playing marker upon a playing space. The players are rewarded with successively higher scores for placing their playing markers upon the playing spaces in such manner that the playing markers are positioned upon the playing spaces in adjacent playing spaces.

In these respects, the board game according to the present invention substantially departs from the conventional concepts and designs of the prior art, and in so doing provides a game primarily developed for the purpose of providing an entertaining and challenging means for learning arithmetic facts.

SUMMARY OF THE INVENTION

In view of the foregoing disadvantages inherent in the known types of board games now present in the prior art, the present invention provides a new board game construction wherein the same can be utilized for providing an entertaining and challenging means for learning arithmetic facts.

The general purpose of the present invention, which will be described subsequently in greater detail, is to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

To attain this, the present invention generally comprises the steps of providing a game board having a plurality of playing spaces arranged in an equal number of rows and columns, providing two sets of playing markers, one set for each of two players, each set of playing markers being distinguishable one from the other, selecting the order of play, each player on his alternating turn placing a playing marker on a playing space until all of the playing spaces have a playing marker placed thereon, and allocating a numerical score to each player for each placement of a playing marker upon a playing space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

It is another object of the present invention to provide a new board game which may be easily and efficiently manufactured and marketed.

It is a further object of the present invention to provide a new board game which is of a durable and reliable construction.

An even further object of the present invention is to provide a new board game which is susceptible of a low cost of manufacture with regard to both materials and labor, and which accordingly is then susceptible of low prices of sale to the consuming public, thereby making such board game economically available to the buying public.

Still yet another object of the present invention is to provide a new board game which provides in the apparatuses and methods of the prior art some of the advantages thereof, while simultaneously overcoming some of the disadvantages normally associated therewith.

Still another object of the present invention is to provide a new board game for providing an entertaining and challenging means for learning arithmetic facts.

Yet another object of the present invention is to provide a new board game which includes the steps of providing a game board having a plurality of playing spaces arranged in an equal number of rows and columns, providing two sets of playing markers, one set for each of two players, each set of playing markers being distinguishable one from the other, selecting the order of play, each player on his alternating turn placing a playing marker on a playing space until all of the playing spaces have a playing marker placed thereon, and allocating a numerical score to each player for each placement of a playing marker upon a playing space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of an alternative embodiment of the present invention.

FIG. 4 is a plan view of the scoring sheet of the present invention.

FIG. 5 is a plan view of the playing markers of the present invention.

FIG. 6 is a perspective view showing a peg.

DESCRIPTION OF THE PREFERRED EMBODIMENT

With reference now to the drawings, and in particular to FIGS. 1 through 6 thereof, a new board game embodying the principles and concepts of the present invention will be described.

Figure 1:
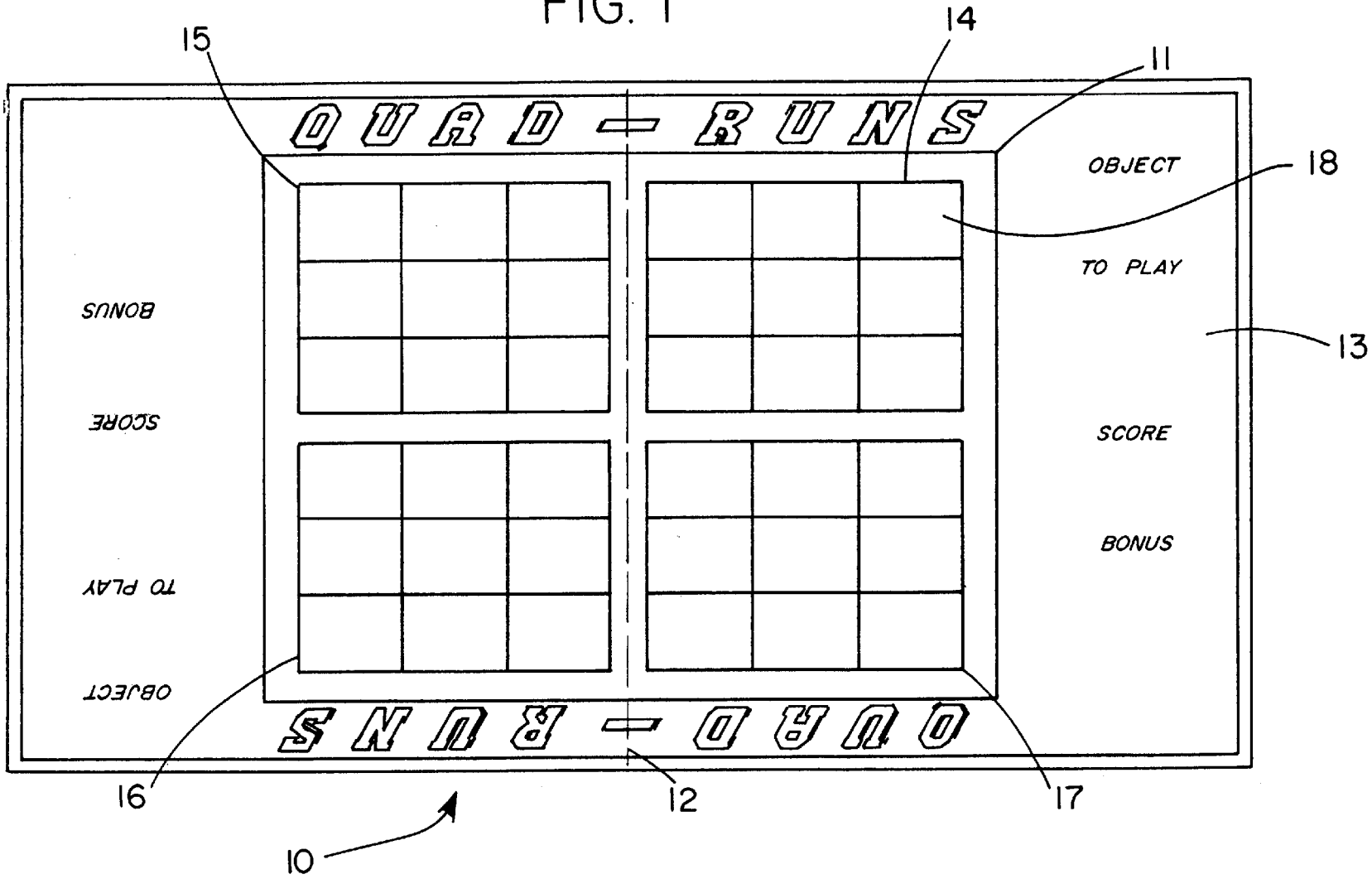
FIG. 1 is a plan view of the game board of the new board game according to the present invention.

With reference to FIG. 1 there is shown a game board 10 having a plurality of playing spaces 18 disposed thereon. The playing spaces 18 are arranged in an equal number of rows and columns. In the preferred embodiment, there are six rows and six columns. The playing spaces 18 are further arranged into four quadrants 14–17, the quadrants 14–17 being bounded by a boundary line 11. A means for folding the game board 10 is shown including a fold line 12. Opposing game board instruction areas 13 are shown disposed in such manner that the playing spaces 18 are disposed intermediate the opposing game board instruction areas 13. The opposing game board instruction areas 13 are designed for allowing the printing of instructions thereon, each set of instructions being identical and being disposed in inverted relationship to the other so that players sitting on opposite sides of the game board 10 can easily read the instructions.

With reference to FIG. 5 there is shown a square playing marker 52 and a round playing marker 54. Each player is allocated a set of distinguishable playing markers consisting of eighteen playing markers, one set being a set of square playing markers 52 and the other set being a set of round playing markers 54.

To play the game, the order of play is selected as by the toss of a coin. Play begins in the first quadrant 14 and proceeds to successive quadrants in a pre-determined direction, such as counterclockwise. Play is confined to the current quadrant of play until all of the playing spaces 18 have a playing marker placed thereon. Each player on his alternating turn places a playing marker upon a playing space 18. If the playing marker so placed is not adjacent to a playing space 18 having a playing marker from the same set of playing markers, one point is scored to the player. Adjacent playing spaces are defined as being playing spaces adjacently disposed along the same row or column or adjacently disposed diagonally from each other. In the terminology of the present invention, the placing of a playing marker in a playing space 18 adjacent another playing space 18 having a playing marker from the same set of playing markers constitutes a run. Runs may be formed in a column, a row, a diagonal extending from left to right or a diagonal extending from right to left. As can be appreciated, each player attempts to place each playing marker upon a playing space 18 in order to maximize the number of runs scored, the maximum number of runs attainable being four (runs in a row, column, diagonal extending from left to right and diagonal extending from right to left).

In the case where a playing marker is placed upon a playing space 18 adjacent to a playing space 18 having a playing marker from the same set of playing markers, runs are scored according to the following rules:

- three points are scored for each of two adjacent playing markers;
- six points are scored for each of three adjacent playing markers;
- ten points are scored for each of four adjacent playing markers;
- fifteen points are scored for each of five adjacent playing markers; and
- twenty points are scored for each of six adjacent playing markers.

Five bonus points are awarded to each player who places his playing markers within the same quadrant in such manner that three playing markers are positioned upon adjacent playing spaces. Ten bonus points are awarded to each player who places his playing markers within two quadrants in such manner that six playing markers are positioned upon adjacent playing spaces.

In the preferred embodiment each player keeps the score of the opposing player. A scoring sheet 50 is shown in FIG. 4 and includes columns for recording the score of each placement of a playing marker by each player and for recording a cumulative score. Thus upon the placement of each playing marker the opposing player determines how many runs the player placing the playing marker has completed and this score is recorded as well as a cumulative score.

Figure 2:
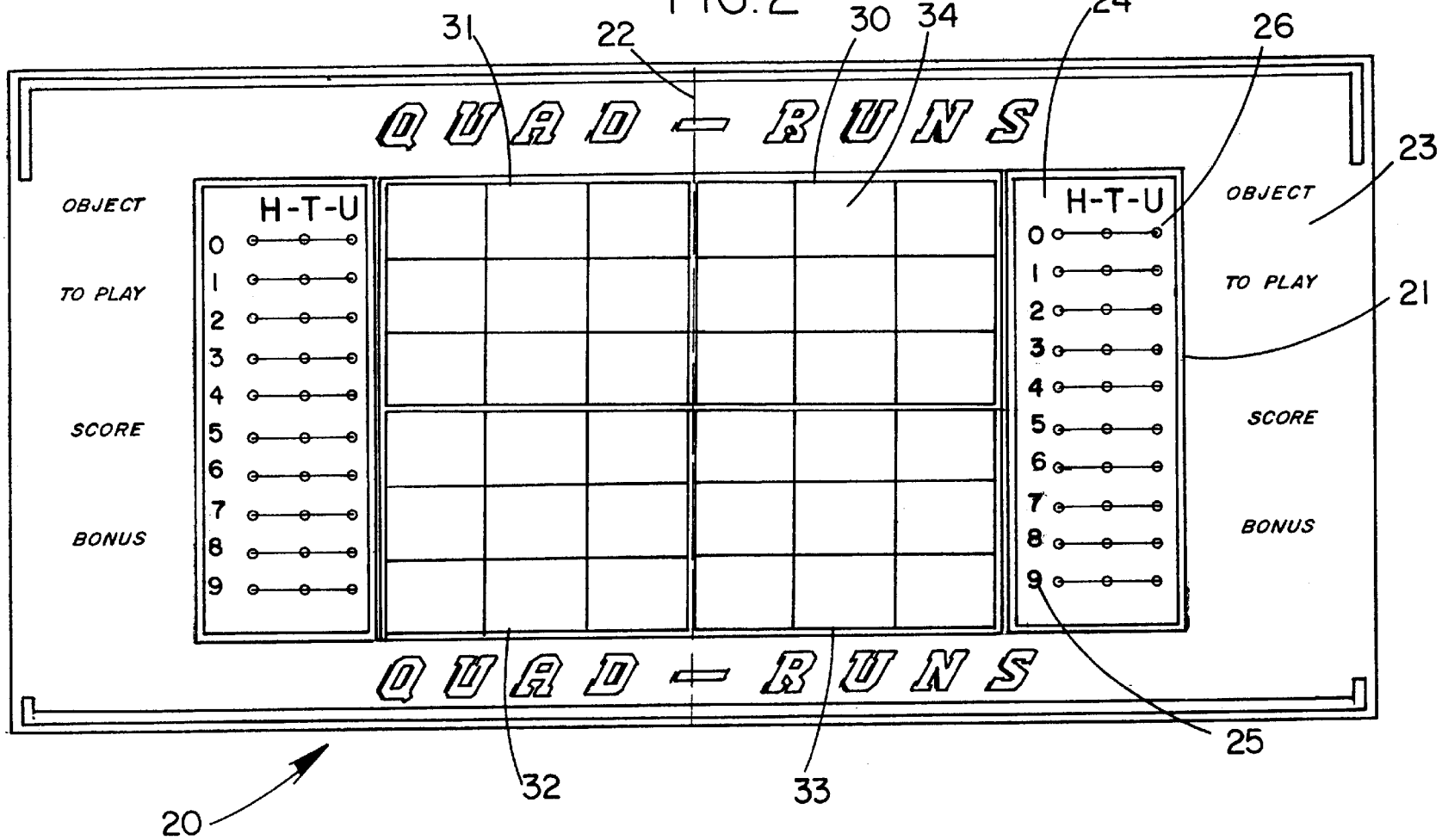
FIG. 2 is a plan view of an alternative embodiment of the present invention.

With reference to FIG. 2 there is shown an alternative embodiment of the present invention. A game board 20 is shown including a plurality of playing spaces 34 arranged in four quadrants 30–33. The game board 20 further includes a means for folding the game board 20 including a fold line 22. A scoring are 24 is shown disposed between an opposing instruction area 23 and the playing spaces 34. The scoring area includes a ten by three array of peg holes 26, the peg holes being designed for receiving a peg 56 having a body 57 and a stem 58. The three columns correspond to the units, tens and hundreds place values, each row corresponding to a numeral 25, the array providing a means for keeping score upon the game board 20.

With reference to FIG. 3 there is shown another alternative embodiment of the present invention. A game board 40 is shown including a plurality of playing spaces 49 arranged in four quadrants 45–48. The playing spaces 49 are disposed intermediate a pair of scoring area 42. Each playing space 49 further is shown including a peg hole for receiving a playing marker having a means for engaging the peg hole. Each scoring area 42 is shown including a ten by three array of peg holes is 42 for scoring as hereinbefore described.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a board game comprising:

providing a game board having a plurality of playing spaces arranged in an equal number of rows and columns;

providing tow sets of playing markers, one set for each of two players, each set of playing markers being distinguishable one from the other;

selecting the order of play;

each player on his alternating turn placing a playing marker on a playing space until all of the playing spaces have a playing marker placed thereon;

allocating a numerical score to each player for each placement of a playing marker upon a playing space; and wherein a first point value is allocated to a player upon the placement of his playing marker upon a playing space in such manner that the playing marker so placed is not adjacent to a playing space having a player marker from the same set of playing markers, a second point value is allocated to a player upon the placement of his playing marker in such manner that two playing markers from the same set of playing markers are positioned upon adjacent playing spaces, adjacent playing spaces being playing spaces adjacently disposed along the same row or column or adjacently disposed diagonally from each other, a third point value is allocated to a player upon the placement of his playing marker in such manner that three playing markers are positioned upon adjacent playing spaces, a fourth point value is allocated to a player upon the placement of his playing marker in such manner that four playing markers are positioned upon adjacent playing spaces, a fifth point value is allocated to a player upon the placement of his playing marker in such manner that five playing markers are positioned upon adjacent playing spaces, a sixth point value is allocated to a player upon the placement of his playing marker in such manner that six playing markers are positioned upon adjacent playing spaces, and wherein adjacent playing spaces having playing markers from the same set of playing markers further comprise runs, each player being allocated points for up to four runs per placement of each playing marker.

2. The method of playing a board game of claim 1, wherein the number of rows and columns is six.

3. The method of playing a board game of claim 2, wherein the thirty six playing spaces are divided into four equal quadrants, play commencing in a first quadrant and proceeding in a pre-determined direction to successive quadrants only upon the placement of playing markers upon all the playing spaces of each quadrant.

4. The method of playing a board game of claim 3, wherein five points are allocated to a player upon the placement of his playing marker in such manner that three playing markers are positioned upon adjacent playing spaces, the adjacent playing spaces being disposed within the same quadrant, and wherein ten points are allocated to a player upon the placement of his playing marker in such manner that six playing markers are positioned upon adjacent playing spaces, the adjacent playing spaces being disposed within two quadrants.

5. The method of playing a board game of claim 1 further comprising the step of providing opposing game board instruction areas in such manner that the playing spaces are disposed intermediate the opposing game board instruction areas, and wherein each opposing game board instruction area further comprises a set of instructions, each set of instructions being disposed in inverted relationship to the other.

6. The method of playing a board game of claim 1 further comprising the steps of providing three pegs and providing a pair of scoring areas, each scoring area being disposed intermediate the playing spaces and opposing game board instruction areas having a set of instructions thereon, each scoring area further comprising a ten by three array of peg holes, the peg holes being for receiving one of the pegs, and wherein the three columns correspond to units, tens and hundreds place values.

7. The method of playing a board game of claim 1 further comprising the steps of providing three pegs and providing a pair of scoring areas in such manner that the playing spaces are disposed intermediate the scoring areas, each scoring area further comprising a ten by three array of peg holes, the peg holes being for receiving one of the pegs, and wherein the three columns correspond to units, tens and hundreds place values, and wherein each playing space further comprises a peg hole, each peg hole being for receiving a playing marker having a means for engaging the peg hole.

8. The method of playing a board game of claim 1, wherein the game board further comprises a means for folding the game board along a fold line.

9. The method of playing a board game of claim 1 further comprising the step of providing a scoring sheet, the scoring sheet having four columns for tallying each player's score.

10. The method of playing a board game of claim 1, wherein a first set of playing markers is comprised of round playing markers and a second set of playing markers is comprised of square markers.

11. The method of playing a board game of claim 10, wherein the round playing markers are green and the square playing markers are red.

* * * * *